US006688215B1

(12) United States Patent
Tipton

(10) Patent No.: US 6,688,215 B1
(45) Date of Patent: Feb. 10, 2004

(54) STACKER WITH INTEGRAL STRAPPER AND MODULAR HEAD ASSEMBLY

(75) Inventor: Allison D. Tipton, Bloomingdale, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/274,342

(22) Filed: Oct. 18, 2002

(51) Int. Cl.[7] ..... B65B 13/02

(52) U.S. Cl. ..... 100/3; 100/7; 100/8; 414/790.2; 414/907

(58) Field of Search ..... 100/3, 4, 7, 8, 100/29, 32, 33 PB; 53/589; 414/790.2, 907, 789.9, 790, 790.1

(56) References Cited

U.S. PATENT DOCUMENTS

| | | | | | |
|---|---|---|---|---|---|
| 4,772,169 | A | * | 9/1988 | Masini | 414/789.6 |
| 5,460,479 | A | * | 10/1995 | Neumann et al. | 414/789.5 |
| 5,540,422 | A | * | 7/1996 | St. John et al. | 270/52.18 |
| 5,617,784 | A | * | 4/1997 | St. John et al. | 100/3 |
| 6,543,341 | B2 | * | 4/2003 | Lopez | 100/4 |

* cited by examiner

*Primary Examiner*—Allen Ostrager
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

An integrated stacker for positioning materials in a stack, compressing the stack and positioning and sealing a strap onto itself around the stacked and compressed materials includes a frame, a conveyor mounted to the frame, and a stacking assembly mounted to the frame. The stacking assembly includes a feed for feeding the materials onto the stack. The stacker further includes aligning arms operably connected to the frame for aligning the materials on the stack, a compression section mounted to the frame for compressing the stack of materials and a strapper section mounted to the frame. The strapper section includes a strap chute for conveying the strap around the compressed stack of material, a feed head for tensioning the strap and a welding head for sealing the strap material onto itself. The strap chute defines a strap path. The feed head, welding head and strap chute are mounted to a bracket that is mounted to the frame along a portion of the strap path. The feed head and the welding head are mounted to the bracket independent of each other and are independently installable onto and removable from the bracket.

6 Claims, 2 Drawing Sheets

STACKER WITH INTEGRAL STRAPPER AND MODULAR HEAD ASSEMBLY

BACKGROUND OF THE INVENTION

The present invention is directed to a stacker such as that used for stacking papers and the like, which stacker has an integral strapper. More particularly, the present invention is directed to a stacker having an integral strapper with modular head components.

Stackers are well known in the art. Typically, a stacker allows for the stacking of, for example, magazines and the like into a stack of such items for easy handling. The stacker conveys the material from a supply into a stacking path. The materials are then stacked onto a rigid element, such as a sized sheet of plywood and onto one another. The stacker assures alignment of the edges of the stacked materials to permit handling efficiency and to reduce the damage that could otherwise occur to the materials. The stacked materials are then compressed and a strap is applied around the materials to secure the stacked and bundled materials into a "log".

In known stackers, the stacker includes, along its length, a location at which a freestanding, fully independent strapping machine can be inserted into the frame. In such an arrangement, the strapping machine is essentially integrated into the stacker for independent operation. In that stackers vary from one manufacturer to another, a variety of strapping machines and/or a single, versatile strapping machine must be configured for insertion into the stacker to integrate with the overall stacking and bundling operation.

Although such versatile strapping machines are available and are commonly known, such strapping machines are often relatively heavy, uniquely designed devices. One such versatile strapping machine is currently commercially available from Signode Container Industry Systems, a division of Illinois Tool Works of Glenview, Ill. Such a strapping machine is manufactured to operate with stackers commercially available from Baldwin Stobb (model Nos. VSB-5 and 150-0L) a division of Baldwin Technology Company, Inc. Other stackers for which this strapper is configured include SMC (model Nos. V3600 and V2000), and Civiemme ST Series Stackers commercially available from IMC America, Inc.

Reiterating, these stackers which are manufactured by different companies, have different configurations and different strapping machine requirements. For example, each of the stackers includes a conveyor along which the bundled materials are transported. The conveyors move the bundled materials away from the stacker area, which areas are a different angles in different machines. Thus, the strappers must be able to accommodate material stacks at different angles. As such, the strapping machine must be configured so that the chute through which the strap traverses can be adjusted to the angle at which the chute is positioned along the conveyor.

Accordingly, there exists a need for a strapping machine that is integrated into a stacker, which the strapping machine is readily configured for mounting without versatility in design. Desirably, such a strapper is integrated into the stacker so that the control system for the strapping machine can likewise be integrated into the control system for the stacker. Most desirably, such a strapping machine includes modular components that can be readily installed on the stacker, which components are interchangeable between like stackers and stacker from different manufacturers.

BRIEF SUMMARY OF THE INVENTION

An integrated stacker positions materials in a stack, compresses the stack and positions and seals a strap onto itself around the stacked and compressed materials. The stacker includes a frame, a conveyor mounted to the frame and a stacking assembly mounted to the frame. The stacking assembly includes a feed for feeding the materials onto the stack.

The stacker includes alignment means mounted to the frame for aligning the materials on the stack and a compression section mounted to the frame for compressing the stack of materials.

The stacker includes an integrated strapper section mounted to the frame. The strapper section includes a strap chute for conveying the strap around the compressed stack of material, a feed head for feeding the strap into and through the strap chute and for tensioning the strap and a welding head for sealing the strap material onto itself. The strap chute defines a strap path.

The feed head, welding head and strap chute are mounted to a bracket that is mounted to the frame along a portion of the strap path. The feed head and the welding head are mounted to the bracket independent of each other and are independently installable onto and removable from the bracket.

In a current stacker, the compression section includes a pair of cylinders each having a compression plate operably mounted thereto. The strap chute is positioned between the cylinders. The strapper section bracket can be mounted to a pair of upright support elements. The bracket defines an opening therein for access of a portion of the feed head and a portion of the welding head to the strap path. The opening can be divided into a first opening for access for the portion of the feed head to the strap path and a second opening for access for the portion of the welding head to the strap path.

The stacker can include a control system. Preferably, the control system includes controls for the strapper section. In this manner, the strapper section is fully integrated with the strapper.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
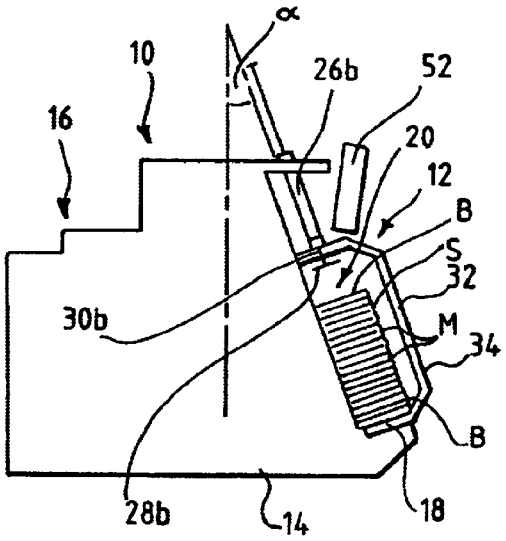
FIG. 1 is a schematic side view illustrating a stacker having an integral strapping machine, the stacker being shown with a stack of material in the strapping section of the machine.
Figure 2:
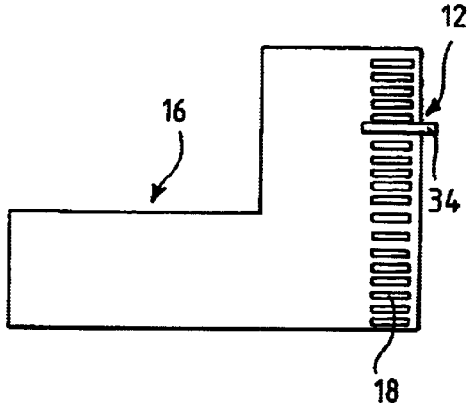
FIG. 2 is a top view of the stacker of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures in particular to FIG. 1 there is illustrated, generally, a stacker 10 having an integrated, modular strapping machine or strapper, indicated generally at 12, embodying the principles of the present invention. The stacker 10 includes a frame 14 having a feed section 16 for feeding the materials M to be stacked and a conveyor 18 along which a stack and/or bundle S of stacked materials is transported. The stacker 10, as will be recognized by those skilled in the art, includes an elongated stacker chute 20 in which the materials M to be stacked are indexed. The stacker chute 20 is inclined at an angle $\alpha$ relative to the conveyor 18 so that the materials M to be stacked can be "leaned" rearward to remain in the stacked orientation. In known stackers, the angle of incline a varies from about 10 degrees to about 30 degrees.

Figure 3:
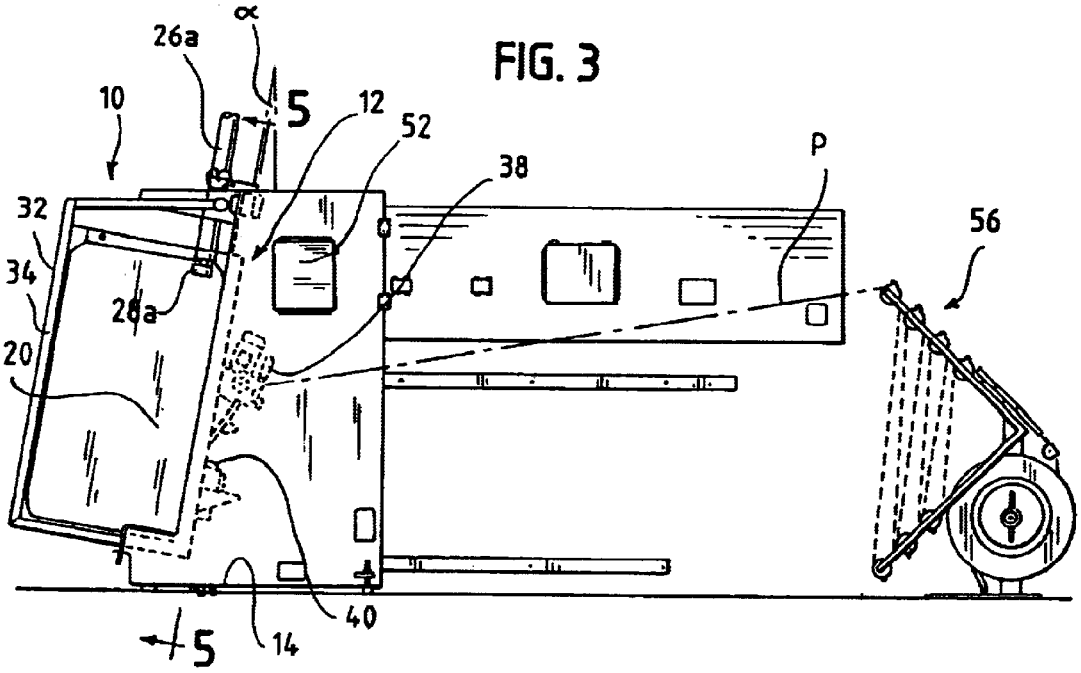
FIG. 3 is a side view of a stacker similar to that shown in FIG. 1, and showing a strap supply arrangement.
Figure 4:
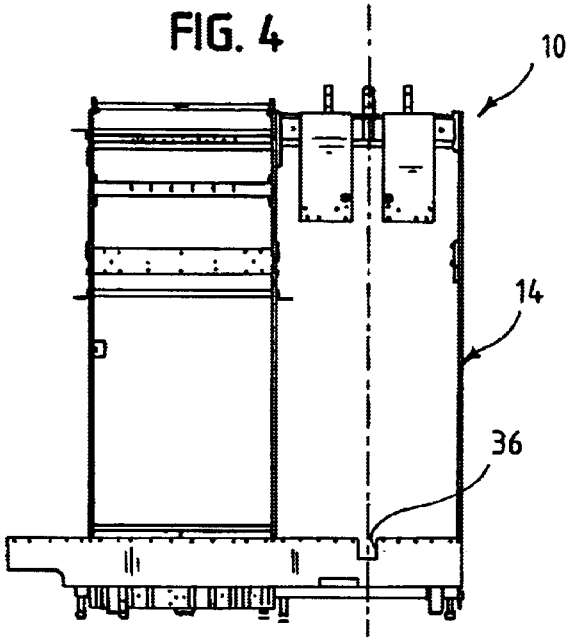
FIG. 4 is a front view of the strapper portion of the stacker of FIG. 3, with the strapping section components removed for clarity of illustration.
Figure 5:
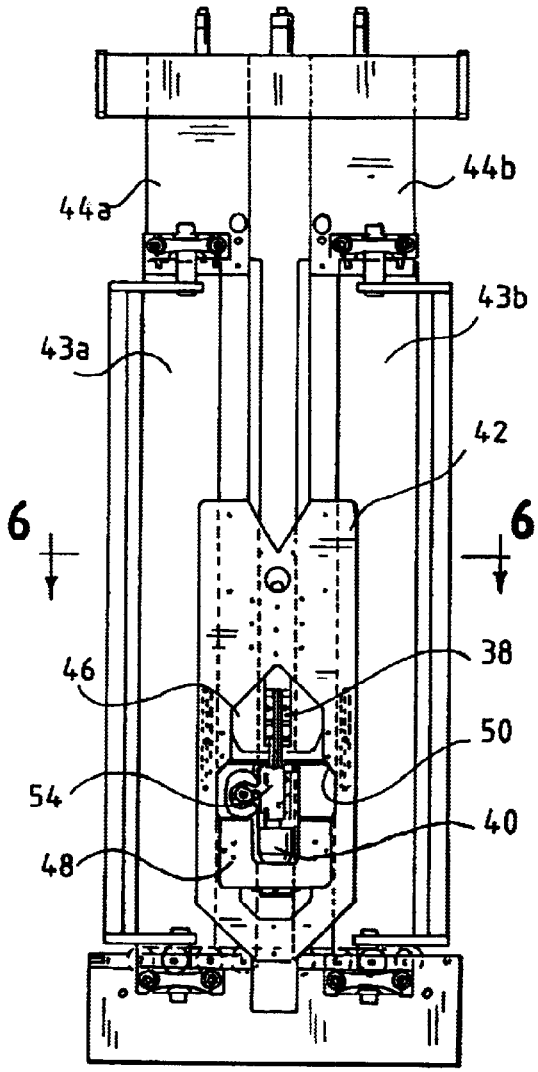
FIG. 5 is a cross-sectional view taken along line 5—5 of FIG. 3.

For purposes of the present invention, the materials M to be stacked may be referred to as magazines or the like. However, those skilled in the art will recognize the various items that can be stacked and bundled in such a stacker 10. FIG. 3 illustrates a similar stacker 10 better showing the stacker frame 14. The illustrated feed section or assembly 16 is exemplary of those used in known stackers 10.

Figure 6:
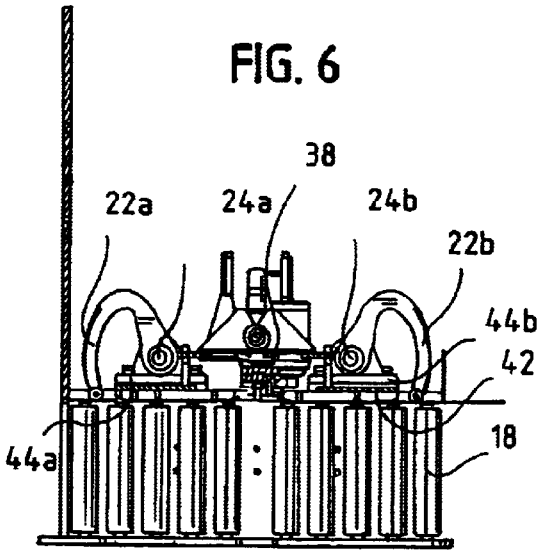
FIG. 6 is a cross-sectional view taken long line 6—6 of FIG. 5.

Referring briefly to FIG. 6, alongside of the stacker chute 20, the stacker 10 includes a pair of arms 22*a,b* mounted to pivoting posts 24*a,b* that swing the arms 22*a,b* inward toward the stack S to assure that the edges of the stacked materials M are aligned. Alignment of the materials M facilitates handling and further reduces the damage that may otherwise occur to the materials M.

Referring again to FIG. 1, subsequent to stacking a desired volume of material M, a rigid element B is placed on top of the material stack S. Such an element B, for example, a plywood board, is typically sized so that it is about the same size as the materials M that are stacked. For purposes of reference, a similar rigid element B is placed on the bottom of the stack S so that the stacked material is essentially "sandwiched" between the rigid elements B.

After stacking and alignment of the materials M, and placement of the rigid element B on the top of the stack S, the stack S is compressed. To carry out such compression, the stacker 10 includes (typically) a pair of cylinders 26*a,b* that have compression plates 28*a,b* at and an end of a shaft 30*a,b* extending from the cylinder 26*a,b*. The cylinders 26*a,b* are actuated, moving the compression plates 28*a,b* into contact the top rigid element B. The action of the cylinders 26*a,b* against the rigid element B compresses the stack S to a desired compression.

The strapping machine 12 is integrated into the stacker 10, mounted to the stacker frame 14. The strapping machine 12 includes a strap chute 34 (which defines a strap path 32) about which the strap P traverses. The strap chute 34 can be fitted into a notch 36 formed in the frame 14 to assure that it is properly positioned. The strapping machine 12 further includes a feed head 38 and a welding head 40. For purposes of the present discussion, those skilled in the art will recognize that oftentimes the strapping head is referred to as that assembly that includes both a feed/retract mechanism as well as a weld mechanism. In the present strapping machine 12, the feed/retract head 38 and the welding head 40 are separate, modular components.

Each the feed/retract head 38 (which will be referred to herein as the feed head) and the welding head 40 are separately mounted directly to the stacker frame 14. That is, these modular components are mounted to the stacker 10 by a mounting bracket 42 that is configured to mount directly to the stacker 10 and to accommodate the modular, "easy on-easy of" mounting of the feed head 38 and welding head 40 to the stacker.

As will be understood by those skilled in the art, the strap chute 34 is disposed on the stacker frame 14 between the compression cylinders 26*a,b*. In this manner, the strap P is positioned around the material stack S between the two loci of compression on the bundled material M. The feed head 38 and welding head 40 are mounted, again, directly to the stacker frame 14 behind the strap chute 34. Behind, in this reference, is meant to define the location of the heads 38, 40 when looking directly at the front of the strap chute 34.

In a present embodiment, the heads 38,40 are mounted to an integrated, universal mounting bracket 42 to support both of the heads 38, 40, independently. The bracket 42 is mounted to a pair of flange brackets 43*a,b* that are, in turn, mounted to a pair of uprights 44*a,b* that extend along and generally parallel to the direction of compression C. The uprights 44*a,b* are part of the overall stacker frame 14. As such, the strapping section heads 38, 40 are directly mounted to the stacker frame 14. Preferably, a single mounting bracket 42 is used for mounting the feed head 38, the welding head 40 and the strap chute 34. This assures proper positioning of the heads 38, 40 relative to one another and relative to the strap chute 34 for proper function of the strapper section 12.

To accommodate a single, universal strapper section 12 design, the mounting bracket 42 is configured as a universal bracket that can be installed on (e.g., mounted to) a wide variety of known stackers 10. To mount the bracket 42 to the stacker 10, the flange brackets 43*a,b* may be specifically designed for one or more particular stackers, however, each distinct set of flange brackets 43*a,b* is configured to accept the universal mounting bracket 42. In this manner, a minimum number of specialized parts (i.e., the flange brackets 43*a,b* only) is needed for a single strapper section 12 design.

The bracket 42 includes mounting elements 46, 48 for the feed head 38 and the welding head 40. These mounting elements 46, 48 permit independently mounting each of the heads 38, 40 to the bracket 42 and thus to the stacker 10. A single opening, as indicated at 50, can be formed in the bracket 42 to permit operation of both the feed head 38 and the welding head 40. As will be recognized by those skilled in the art, the opening 50 permits the necessary portions of the feed head 38 and the welding head 40 to be interposed in the strap path 32 (i.e., access to the strap path 32) for operating on the strap P.

The feed head can include a cutter 54 for severing the strap P to separate the strap P from the strap supply 56 (FIG. 3). The illustrated supply 56 permits a substantially constant feed of strap P material to the stacker 10 at a relatively constant tension.

Nevertheless, each the feed head 38 and the welding head 40 are independently mounted to the bracket 42, which in turn is mounted to the strapper frame 14. This provides a number of advantages over known, independent strapping machines inserted into the stacker. First, space necessary for insertion of an entire strapping machine into the stacker is no longer necessary. This is because the strapping machine components (i.e., the heads 38, 40) are mounted to the strapper 10, rather than independently inserted (e.g., wheeled) into stacker.

In addition, in strapping machines utilizing an integrated strapping head that includes both the feed head and welding head portions, such strapping heads can weigh in excess of 125 pounds. This weight, in conjunction with the stresses associated with operation of the feed and welding heads, requires considerable structural support for the independent strapping machine.

The present arrangement, on the other hand, eliminates these traditional structural elements. Each the feed head 38 and the welding head 40 weigh generally no more than about 30 pounds. As such, the overall weight of components that are supported by the stacker frame 14 is considerably within the structural capabilities of known stackers without modification.

Moreover, as will be appreciated by those skilled in the art, the modular design, i.e. separate and independent configuration of the feed head 38 and welding head 40, provides for relatively fast and easy maintenance of the overall stacker 10. That is, in the event that maintenance is needed on, for example, the welding head 40, the stacker 10 can be taken out of service, the welding head 40 removed and if available, a replacement welding head installed on the machine 10 and the machine 10 placed back in service. In that the design of these heads 38, 40 is modular, such a replacement operation can be carried out in minutes, rather than hours that may be required in known configurations that utilize separate, e.g., wheeled-in, strapping machines.

Furthermore, having a separate feed head 38 and welding head 40 makes stocking or storing spare heads more economically feasible. That is, in an operation that utilizes a number of stackers 10 (even if different stackers are used) a single spare feed head 38 and a single spare welding head 40 (interchangeable between different stacker manufacturers' machines) can be maintained in inventory or stores for use in the event of malfunction or required maintenance. In that the integrated components of the strapping section 12 in the stacker 10 is intended for functioning with a wide variety of stackers 10, it makes economical "sense" to keep spare heads 38, 40 in inventory.

To facilitate integrating overall operation of the stacker 10 (including the strapper section 12), the electrical components for the strapper section 12 of the stacker 10 can be integrated into the overall control system 52 for the stacker 10 such overall integration is readily carried out with any of the known stackers 10 and it is anticipated that such integration will be able to be carried out with new generations and models of stackers that come available in the market in the future. Such an integration is readily carried out by incorporating the necessary hardware and software for carrying out strapper section 12 operating steps, and other controls and functions into the stacker 10 in an operation that is essentially downstream of the stacking operation. As such, the strapping operation, although integrated into a single machine, is carried out as a downstream function independent of the stacking function. The single integrated controller 52 can be configured with all of the necessary control and monitoring components and functions.

All patents referred to herein, are hereby incorporated herein by reference whether or not specifically do so within the text of this disclosure.

In the present disclosure, the words "a" or "an" are to be taken to include both the singular and the plural. Conversely, any reference to plural items shall where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should disclosure is intended to cover by the appended claims all such modifications as fall within the scope of the claims.

What is claimed is:

1. An integrated stacker for positioning materials in a stack, compressing the stack and positioning and sealing a strap onto itself around the stacked and compressed materials, comprising:

a frame;

a conveyor mounted to the frame;

a stacking assembly mounted to the frame, the stacking assembly including a feed for feeding the materials onto the stack;

alignment means mounted to the frame for aligning the materials on the stack;

a compression section mounted to the frame for compressing the stack of materials, the compression section includes a pair of cylinders each having a compression plate operably mounted thereto, a strap chute being positioned between the cylinders;

a strapper section mounted to the frame, the strapper section including the strap chute for conveying the strap around the compressed stack of material, a feed head for feeding the strap into and through the strap chute and for tensioning the strap and a welding head for sealing the strap material onto itself, the strap chute defining a strap path, the feed head, welding head and strap chute being mounted to a strapper section bracket that is mounted to the frame along a portion of the strap path, the feed head and the welding head being mounted to the strapper section bracket independent of each other and being independently installable onto and removable from the strapper section bracket, wherein the strapper section bracket is mounted to a pair of upright support elements of the frame and wherein the strapper section bracket defines an opening therein for access of a portion of the feed head and a portion of the welding head to the strap path.

2. The stacker in accordance with claim 1 including a control system, wherein the control system includes controls for the strapper section.

3. The stacker in accordance with claim 1 wherein the feed head includes a cutter for severing the strap.

4. The stacker in accordance with claim 1 wherein the strapper section bracket is mounted to the frame at first and second flange brackets, and wherein the first and second flange brackets are mounted to the pair of upright support elements.

5. An improved stacker for positioning materials in a stack, compressing the stack and positioning and sealing a strap onto itself around the stacked and compressed materials, the stacker having a frame, a conveyor mounted to the frame, a stacking assembly mounted to the frame having a feed for feeding the materials onto the stack, alignment means mounted to the frame for aligning the materials on the stack, and a compression section mounted to the frame for compressing the stack of materials, the improvement comprising;

a strapper section mounted to the frame, the strapper section including a strap chute for conveying the strap around the compressed stack of material, a feed head for feeding the strap into and through the strap chute and for tensioning the strap, and a welding head for sealing the strap material onto itself, the strap chute defining a strap path, the feed head, welding head and strap chute being mounted to a strapper section bracket that is mounted to the frame along a portion of the strap path, the feed head and the welding head being mounted to the strapper section bracket independent of each other and being independently installable onto and removable from the strapper section bracket, wherein the strapper section bracket is mounted to a pair of upright flange brackets of the frame and wherein the strapper section bracket defines an opening therein for access of a portion of the feed head and a portion of the welding head to the strap path.

6. The improved stacker in accordance with claim 5 including a control system, wherein the control system includes controls for the strapper section.

* * * * *